United States Patent [19]

Avellone

[11] 4,401,523

[45] Aug. 30, 1983

[54] APPARATUS AND METHOD FOR PLATING METALLIC STRIP

[75] Inventor: Richard C. Avellone, Mayfield Heights, Ohio

[73] Assignee: Republic Steel Corporation, Cleveland, Ohio

[21] Appl. No.: 379,962

[22] Filed: May 19, 1982

Related U.S. Application Data

[63] Continuation-in-part of Ser. No. 217,806, Dec. 18, 1980, which is a continuation-in-part of Ser. No. 22,618, Mar. 21, 1979, abandoned.

[51] Int. Cl.[3] ..... C25D 5/02; C25D 5/08; C25D 7/06; C25D 17/00

[52] U.S. Cl. ..... 204/15; 204/28; 204/206; 204/211

[58] Field of Search ..... 204/15, 28, 206, 211

[56] References Cited

U.S. PATENT DOCUMENTS

| | | | |
|---|---|---|---|
| 242,813 | 6/1881 | Chinnock | 204/207 |
| 1,991,817 | 2/1935 | Nachtman | 204/28 |
| 2,244,423 | 6/1941 | Hall | 204/28 |
| 2,267,146 | 12/1941 | Wilson | 204/206 |
| 2,461,556 | 2/1949 | Lorig | 204/DIG. 7 |
| 2,462,506 | 2/1949 | Klein | 204/225 |
| 2,477,808 | 8/1949 | Jones | 204/211 |
| 2,490,055 | 12/1949 | Hoff | 204/206 |
| 2,569,577 | 10/1951 | Reading | 204/28 |
| 2,695,269 | 11/1964 | DeWitz et al. | 204/206 |
| 2,723,953 | 11/1955 | Burgemeister | 204/211 |
| 2,924,563 | 2/1960 | Gray | 204/198 |
| 2,989,445 | 6/1961 | Lloyd et al. | 204/28 |
| 3,354,070 | 11/1967 | Carter | 204/206 |
| 3,445,371 | 5/1969 | Johnston | 204/206 |
| 3,468,783 | 9/1969 | Avellone | 204/28 |
| 3,644,181 | 2/1972 | Donaldson | 204/15 |
| 3,692,640 | 9/1972 | Hamabe et al. | 204/28 |
| 3,697,399 | 10/1972 | Usui | 204/15 |
| 3,855,083 | 12/1974 | Hoeckelman | 204/28 |
| 3,901,771 | 8/1975 | Froman | 204/28 |
| 3,975,242 | 8/1976 | Matsuda | 204/28 |
| 3,988,216 | 10/1976 | Austin | 204/28 |
| 3,989,604 | 11/1976 | Austin | 204/28 |
| 4,014,773 | 3/1977 | Furuya | 204/206 |
| 4,119,516 | 10/1978 | Yamaguchi | 204/206 |
| 4,267,024 | 5/1981 | Weiskopf | 204/15 |

*Primary Examiner*—T. M. Tufariello

*Attorney, Agent, or Firm*—Watts, Hoffmann, Fisher & Heinke Co.

[57] ABSTRACT

Method and apparatus for electrogalvanizing one or both sides of a steel workpiece are disclosed. A series of insoluble apertured plating anodes are positioned in spaced relation to the workpiece. When one side is to be plated one or more anodes are preferably mounted above the strip and when both sides are plated, anodes are mounted both above and below the strip. Solution is pumped through the holes in the anodes to momentarily contact the workpiece and they fall into a sump to be recirculated. A potential difference between the anode or anodes and the workpiece causes current flow through the electrolyte solution to electroplate the workpiece. Solution collection by the sump is directed to a reaction station for replenishment of the zinc metal ion. The solution is then filtered back to a main reservoir tank from which it is again pumped to the plating anodes.

24 Claims, 15 Drawing Figures

HYD. RES. & PUMP
CONTROL VALVE
MASK BOX
STRIP MOTION
CONTROL
OVER-LAP
FROM STRIP CONDITION
TRACKING ARM
OVERLAP
MASK BOX POT 330
CYL.

APPARATUS AND METHOD FOR PLATING METALLIC STRIP

DESCRIPTION

This application is a continuation-in-part of U.S. Ser. No. 217,806 filed Dec. 18, 1980, which in turn is a continuation-in-part of U.S. Ser. No. 022,618 filed Mar. 21, 1979, now abandoned.

TECHNICAL FIELD

It is customary to use galvanized steel product in applications where, but for a protective zinc coating, the life of the product would be unacceptably short. Until relatively recently, it was customary to protect an entire product with a galvanized coating. Either strip steel which had been zinc coated was employed in fabrication or, alternatively, a finished product was fabricated and then coated with zinc.

BACKGROUND ART

In relatively recent times, applications have developed where it is economically or otherwise desirable to galvanize only one surface of a strip of steel. Other applications require coatings of different thickness on opposed strip surfaces.

Examples where a one-side coated steel is used are wall panels for buildings and automotive components. Automobile rocker panels, for example, frequently are heavily galvanized on their internal surfaces to inhibit corrosive attack by water trapped inside the panels, especially when that water contains road salt or other chemicals, while the external surfaces are provided with a smooth uncoated finish for appearance.

A differential coating is often desirable for automotive parts. A relatively thick coating of zinc is applied to interior surfaces of the part and a thin coating is applied to exterior surfaces. The thin exterior coating inhibits corrosion in the event of scraping and/or denting of the car finish.

While a need exists for steel which is galvanized on one surface, or alternately in a differential manner to both surfaces, the techniques which have been used in the past were wasteful and inefficient, or required an enormous investment, or both.

One technique for one side coating is to hot dip the steel in molten zinc with one face treated in a manner that is intended to prevent its being coated. Techniques for keeping the zinc on one side of a thin, flat strip product, however, have been difficult to achieve. The hot dip technique has also physically changed the properties of the steel being plated and does not produce the uniformity of coating which can be achieved with electroplating techniques.

A second known technique is to use a conventional electrolytic strip plating line modified to maintain the level of plating solution at a level where it contacts only the lower surface of a strip of steel being plated, in hopes of plating only that lower surface. Unfortunately, even when the level of the plating solution is controlled very precisely, there is considerable splashover and marginal portions of the top surface of the strip become plated due to this splashing of the solution. With this technique the top coated marginal portions are cropped off and only a central portion of a strip produces a useful one-side coated product. The cropped portions typically are scrapped or used in applications which require poor quality steel because, although perhaps plated effectively on the lower surface, the splashed over surface is irregularly and poorly plated and not useful for products demanding quality strip.

Other techniques for one side plating have been developed which mask one surface while plating the other. For example it is known to provide a strip of soft steel that is reeved over rollers that are partially immersed in a plating bath and function to mask the surface which they contact as the opposite surface is plated. It will be appreciated that the apparatus is complex and requires a very significant capital investment. The required capital investment is heightened when one appreciates that for automotive applications the galvanized coating must be relatively heavy which means either slow throughput, or alternately for an efficient line, a relatively long and expensive line to develop the thick coating desired.

Most known electroplating systems use consumable electrodes. That is, the electrodes each include a rather large piece of zinc for anodic solution to replenish the zinc ions plated out onto the workpiece. As electrode zinc is consumed, electrode-to-workpiece spacing changes and due to this and other variables, very precise and uniform plating thickness is difficult to achieve.

Because of the variables which are inherent in consumable electrode plating the equipment and controls for systems performing such plating are expensive and complex. For example, sophisticated electrical controls have been developed which monitor and compensate for variations in several plating parameters in an attempt to achieve more uniform plating with consumable electrodes.

There also have been proposals to use nonconsumable electrodes. A nonconsumable electrode is a conductive material which is maintained at a potential differential with the workpiece so that current flow between the electrode and the workpiece will plate zinc ions onto the workpiece from an electrically conductive plating solution filling the space between the electrode and the workpiece. As the ions are reduced to the metallic state onto the workpiece, however, the solution adjacent or near the workpiece becomes depleted of zinc metal ions. High speed efficient plating cannot therefore be achieved with nonconsumable electrodes unless the proper concentration of the zinc ions is maintained by other means at the workpiece surface. Problems of replenishing or maintaining the zinc ion concentration have inhibited the performance of prior nonconsumable anode systems, with the result that they have not enjoyed significant commercial success.

The use of a nonconsumable anode is shown in U.S. Pat. No. 2,244,423, to Hall. The anode disclosed in that patent includes a series of apertures through which plating solution flows to contact a strip to be plated. While in theory capable of achieving one side and/or differential two side plating the Hall structure is deficient for a number of reasons.

The Hall structure allows the plating solution to flow off the strip but this flow is constricted by gutters which bound the strip. This constricted fluid flow can cause the solutions's ion concentration near the strip to become depleted at an uncertain rate as plating occurs, with resultant non-uniformity of plating thickness.

A second deficiency of the Hall plating apparatus involves its orientation of anode and strip. With the anode mounted beneath the strip to plate the strip underside, it is possible that pockets of gas may collect on the strip as the plating process occurs. This problem is especially likely due to the gutter-caused constriction of fluid flow away from the strip. When a gas pocket forms, plating current from the anode to the strip is disrupted and non-uniform strip plating results.

A further problem inherent in the Hall structure is its use of multiple anodes across the workpiece which are separated by gaps. It is believed impossible to maintain such electrically isolated anodes at identical electrical potentials. Therefore, bi-polar plating action occurs between anodes. That is, a lower potential anode will act as a cathode to higher potential anodes and zinc will be plated onto the lower potential anode. Plating effectiveness of the plated anode is obviously reduced.

Use of separate anodes can result in non-uniform plating due also to non-uniform plating current density created by the gaps between anodes.

DISCLOSURE OF THE INVENTION

With the present invention, an improved insoluble anode plating technique especially adapted for galvanizing a strip of steel has been developed. According to the technique, an anode assembly is positioned in relatively closely spaced relationship with the workpiece. The assembly and workpiece are configured and located to define a fluid flow path for plating fluid. The plating fluid is supplied to the flow path in a quantity sufficient to maintain at least a portion of the flow path across the workpiece substantially filled at all times with flowing solution so that plating is accomplished continuously and uniformly across the entire width of the workpiece.

The solution flows from the fluid flow path, dropping into a sump where is it collected, sent to a zinc ion replenishment station and, once the zinc ions are replenished, recirculated through a filter and returned to the flow path.

The system of this invention has a number of distinct advantageous features. One such feature is means for selectively positioning the insoluble anode or anodes in relation to the strip so that fluid flows over only selected strip portions, such as over one side of the strip workpiece. Alternately, an anode may be positioned on both strip sides to provide a differential plating capability. Another major advantage is that because there is a relatively high rate of fluid flow, uniform metal ion replenishment rates are provided which overcome previous deficiencies of nonconsumable anode systems, that have in the past limited their use.

In a preferred embodiment of the invention, the anode is mounted near the strip, and defines, conjunctively with the strip, an insoluble anode container region for receiving the plating solution flow. The anode container comprises a plating surface of the anode parallel to the workpiece surface to be plated. Plating solution is pumped to the anode and passes through apertures in the anode's plating surface. The flowing solution contacts the steel strip surface and fills the gap between the anode and the strip. As the strip moves past the anode, plating occurs due to the current flow between the anode and the strip. The solution then flows from the edge of the strip and is caught by a sump tank for later recirculation to the anode. At a location removed from the anode container, a source of zinc ions continuously replenishes those ions used in the plating process.

One criterion that must be satisfied if uniform plating is to be achieved is the maintenance of a uniform gap between the anode and the strip. With a soluble anode the plating current becomes non-uniform due to changes in the physical configuration of the anode. The present invention's use of an insoluble anode removes this undesirable variable.

To achieve one side plating the anode is preferably positioned above the strip. If both sides are to be plated, anodes constructed in accordance with the invention may be positioned both above and below the strip. By adjusting the relative electric potential between the strip and anodes a different coating thickness can be applied to each of the two strip surfaces.

When an anode is positioned below the strip, gas pockets must be prevented from accumulating on the strip and interfering with plating. The improved solution flow characteristics achieved through practice of the invention removes and prevents detrimental gas accumulations. Furthermore, according to one embodiment of the invention, both the strip and anode plating surface are mounted at an angle to the horizontal. The arrangement permits increased solution flow and metal ion replenishment, facilitates air and electrode gas removal and helps to maintain strip flatness and tension through the plating zone.

An important feature of the invention involves the control of current flow from the anode to the strip. To insure uniform plating thickness across the width of the strip, masking plates are inserted in the path of solution flow. These plates are electrically insulating and reduce plating current at the strip edges to reduce two undesirable phenomena known as "tree growth" and "edge buildup". As strips of varying widths are plated, these insulator plates or masks are adjusted appropriately to achieve the more uniform plating deposition.

A preferred embodiment includes also an automatic system for maintaining a constant amount of mask overlap over the strip edge, notwithstanding sideways "wander" or deviation, of the strip as it moves. A tracking sensor, just ahead of the plating cell, continuously senses strip edge lateral location, transverse to longitudinal strip movement. A mask adjustment section compares strip edge location with actual lateral mask location, and adjusts mask location to maintain the mask at a constant lateral position relative to the strip edge.

In another specific embodiment, the mask defines a notch or groove into which the strip edge protrudes, to better guard against undesirable edge plating phenomena.

If the strip is plated on both surfaces, the anodes may be horizontally aligned one above the other with the strip passing between or the anodes may be staggered along the strip length. Positioning the top anode or anodes above the bottom anode or anodes is economical but can cause bi-polar plating action between opposed anodes. That is, the potential maintained on one of two closely positioned anodes may be higher than the potential of the other, causing zinc to be plated on the lower potential anode. In the present invention, the plating of an anode by bipolar action is avoided by use of the insulated masking plates which are inserted between the two anodes. The masks inhibit plating current from flowing between the anodes and thus inhibit plating of the lower potential anode.

The use of a single anode on each side of the strip to be plated inhibits bi-polar plating, as compared to previous proposals for use of plural adjacent anodes.

Another specific embodiment provides for unequal solution flow from top and bottom anodes. Greater flow from the bottom helps flush away gases from the strip underside, and also helps support the weight of the strip to reduce bowing.

From the above it is apparent that one object of the present invention is to provide apparatus and method for one-side, two-side or for two-side differential plating of a strip of steel or the like. Use of a flat non-soluble anode insures that uniformity of the preset gap between anode and strip does not change during electrolysis. Electrical insulators placed within or near the gap enhance uniformity of plating across the width of the strip. These and other features of the present invention will become more apparent as the invention becomes better understood from the detailed description that follows, when considered in connection with the accompanying drawings.

BEST MODE FOR CARRYING OUT THE INVENTION

Figure 1:
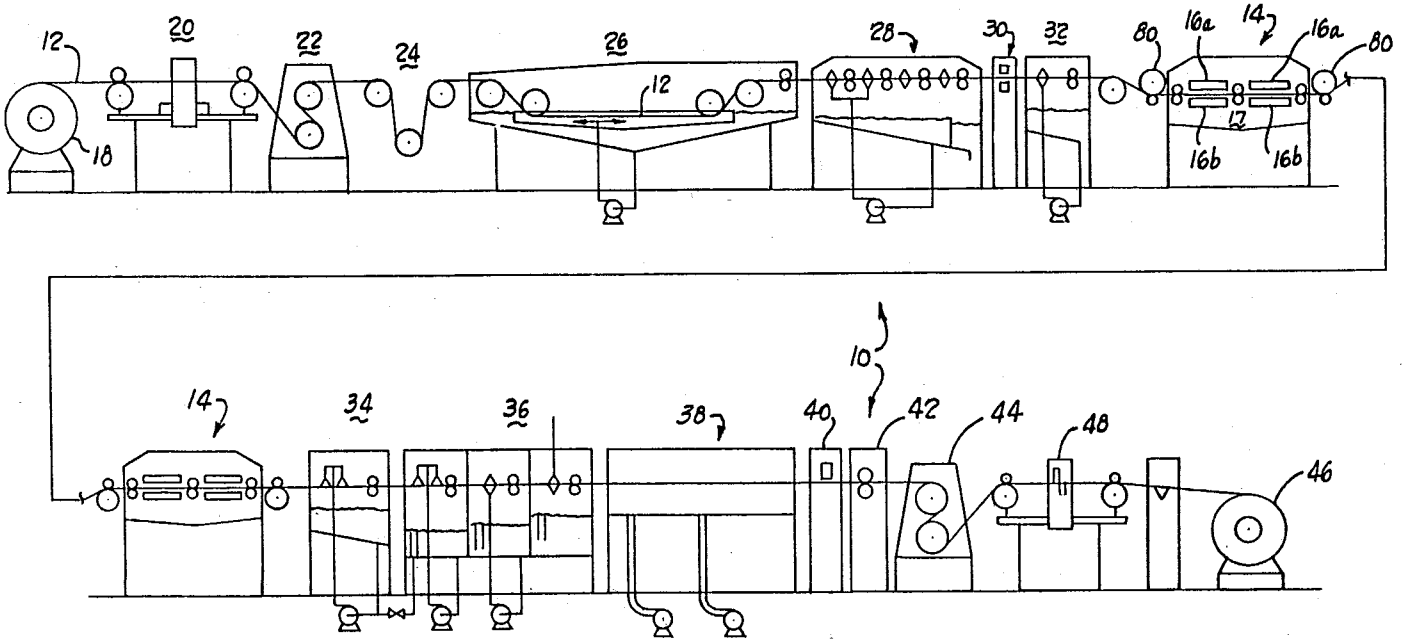
FIG. 1 is a graphical illustration of a plating line incorporating the present invention.

Turning now to the drawings, FIG. 1 shows a plating line 10 constructed in accordance with the present invention. The line is particularly suited for applying a zinc coating to one or both sides of a steel strip 12. A plating section 14 comprising a portion of the line includes a number of anodes 16 mounted both above and below the strip. Those anodes **16*a* positioned above the strip provide plating current through a zinc ion containing solution 17 to plate zinc onto the strip's upper surface and those anodes 16*b*** positioned below the strip provide a similar plating current for zinc plating the strip's bottom surface.

A number of preparatory steps upstream of the plating section must be performed prior to plating. As a first step, the strip must be unwound from a payoff reel 18 and fed to a welding station 20. At the welding station 20 the end of one strip is welded to the beginning of the strip to be unwound from the payoff reel 18 to form a continuous strip to be plated. During the welding step strip motion is stopped.

Following the welding station 20 the strip is fed through a drag bridle roll 22 and a strip tracking control 24. The drag bridle roll 22 maintains tension in the strip and the tracking control 24 helps keep the strip centered along its path of travel.

After exiting the tracking control the strip is fed through an alkaline cleaner or the like followed by an acid cleansing bath 26 comprising a suitable acid such as hydrochloric acid. The acid removes foreign substances and/or oxides from the steel and prepares the steel surface for electroplating. After the strip exits the acid bath any acid clinging to the strip is rinsed off at a scrubber/rinse station 28.

Prior to entering the plating section 14 the centering of the strip is checked at a track monitoring station 30 and if the strip is off center corrective steps are taken at the tracking control station 24 to recenter the strip.

Immediately prior to entering the plating section 14 a solution of zinc containing liquid such as zinc sulphate is applied at a strip conditioner station 32. Application of the zinc spray causes enhanced plating performance by forming a non-porous barrier film for inhibiting corrosion of the pickled and cleaned steel surface prior to plating, and by acting as a seed for the plating process. This step also makes sure the strip is wet when it enters the plating section 14. Tests have shown that the characteristics of the zinc sulphate solution are preferably governed by the following table:

| Zinc Sulphate Data: ($ZnSO_4 * H_2O$ = 36.4% Zn) | Optimum | Range |
|---|---|---|
| $ZnSO_4 * H_2O$ | 200 g/l. | 40–280 g/l. |
| Equivalent Zn metal | 72 g/l. | 15–102 g/l. |
| PH | 2.0 | 1.5–2.5 |
| Temperature | 80° F. | Room–130° F. |

After one or both of the strip's surfaces are plated by a process to be described, the strip leaves the plating section 14 and enters a zinc reclaiming station 34. At this station plating bath solution withdrawn on the strip surface is collected. The strip 12 is then rinsed and dried at a rinsing station 36 and a drying station 38 respectively.

The coating weight of the dry strip is measured at a coating weight station 40. If the coating weight is not equal to a desired value corrective measures are taken. These measures include strip speed adjustment and changing the potential difference between some or all the anodes and the strip.

After the strip is tested for coating weight it passes through a brush wipe 42 and an exit bridle roll 44 and is stored on a coiling reel 46. Periodically strip motion is stopped, the strip is cut by an exit shear 48, a full coiling reel is removed, and an empty coiling reel is positioned for receiving more zinc coated strip.

The line 10 can be adapted for either one or two side plating. When only one side is plated, according to the preferred embodiment of the invention only the upper anodes **16*a* are mounted in relation to the strip. Details of one side only strip plating are illustrated in FIGS. 2–6**.

Figure 2:
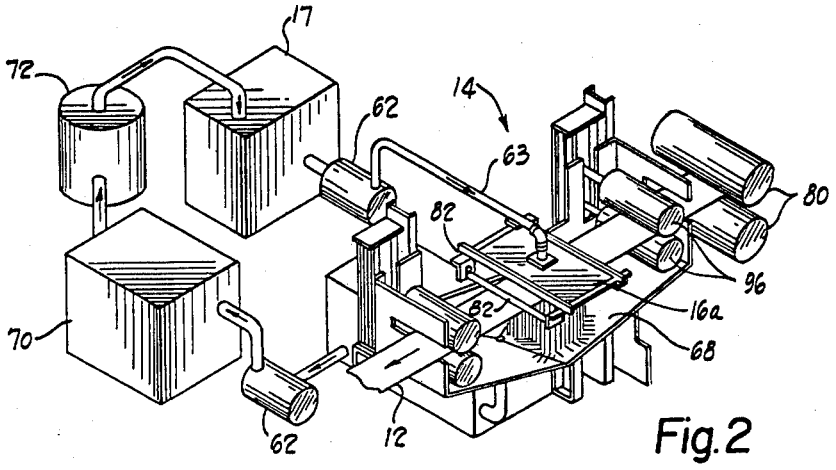
FIGS. 2 and 3 are fragmentary views, partially broken away, of a portion of the system of FIG. 1.

The one side only plating system 10 as shown comprises a plating unit shown at 14 in FIG. 2. The plating unit comprises an anode 55 spaced above the workpiece, and is constructed to receive a plating solution. For illustration purposes, only one anode has been shown, but it should be appreciated that a commercial plating line may include 30 or more of these. The solution is circulated from a reservoir 57 of plating material via two pumps 62 and a conduit 63. From the conduit the solution enters the anode 14 from which it exits to flow over the workpiece.

The anodes are suspended above the workpiece with a small gap maintained between the workpiece and the anode. Plating solution fills this gap after it exits the anode and then flows off the workpiece and is collected by a sump 68. The collected solution then proceeds to a reaction station 70, through a filter 72, and to the main reservoir to be recirculated to the anode. In the schematic illustration shown in FIG. 2, the sump 68 has been shown with one side broken away to illustrate solution flow from the workpiece.

As the plating process begins, a suitable zinc plating solution enters the anode with a ph ranging upwards to 4.5, preferably in a range of 1.5–2.5, and with a temperature greater than ambient and preferably about 60° C. This solution is prepared with technical grade zinc sulfate salts and purified with carbon and zinc dust. The zinc sulfate salts dissociate and provide zinc ions for the plating.

The workpiece and anode are maintained at different electrical potential by a source of electrical energy such as provided by a D.C. rectifier. This energy difference causes electropolating to occur on the workpiece due to electron flow from the anode to the workpiece. The electroplating reaction follows the known equation $2e^- + Zn^{++} Zn^o$. Electrons necessary to complete this reaction flow through the anode which must therefore comprise a metallic or suitable conductive material. In one embodiment of the invention, the anode is constucted from a lead-silver alloy material. One corrosion resistant material suitable for anode construction comprises ½% silver and 99½% lead.

Rectifier current is controlled by a control module with a control output proportional to line speed and steel strip width. Details of this rectifier current control can be found in co-pending U.S. patent application Ser. No. 8,594 entitled "Plating Control" which has been assigned to the assignee of the present invention and which is incorporated herein by reference.

As the plating is deposited on the workpiece, the zinc ion concentration diminishes. To maintain ion concentration, the reservoir 17 is continually replenished with zinc ions at the reaction station 70. A preferred ion replenishment is accomplished by placing metallic zinc and zinc oxide in the plating solution contained in the reaction station. As the plating out of zinc ions occurs sulfuric acid is generated at the anode. This acid is used to aid in the solution of the metallic zinc and zinc oxide to produce zinc sulfate which dissociates to create zinc ions for the plating procedure.

Relative longitudinal motion between the anodes 16*a* and the workpiece 12 is applied by drive rollers 80. The current density on the workpiece, the desired plating thickness and the number of anodes, dictate how fast these drive rollers should drive the workpiece.

The gap width between the anode 16*a* and the workpiece 12 is adjustable. This adjustment is achieved by a guide roller 82 positioned on either side of the unit 16*a*. As the guide rollers are moved up or down relative to the anode, the gap between workpiece and anode either diminishes or increases.

Figure 3:
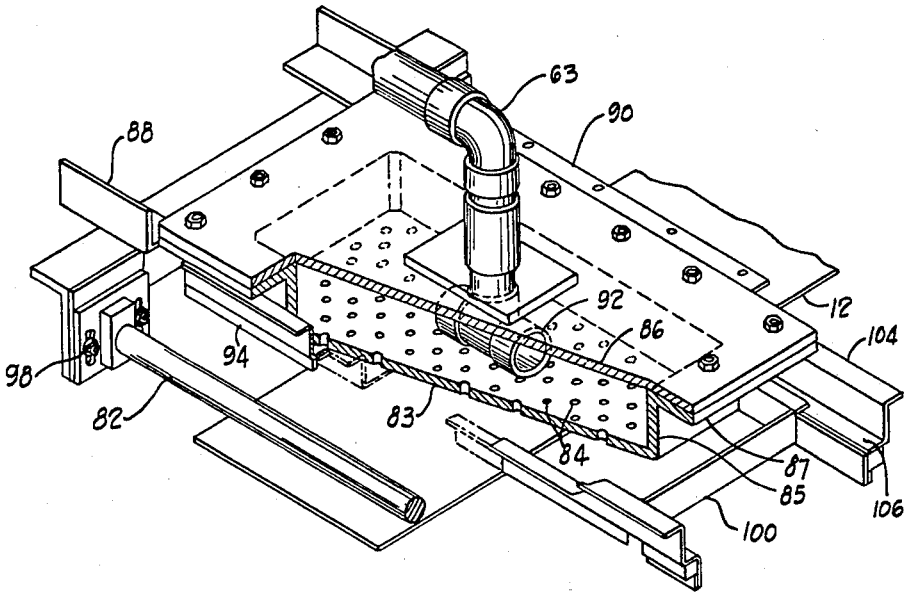
Figure 4:
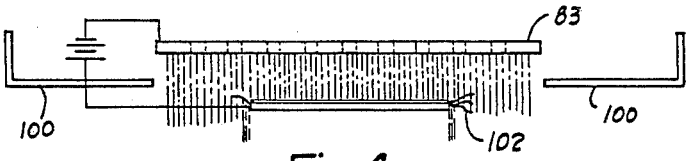
FIGS. 4 and 5 are end views in cross-section of a portion of the system of FIG. 1.
Figure 5:
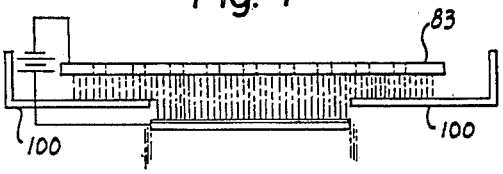

One preferred embodiment of the anode unit 16*a* is illustrated in FIG. 3. It is a rectangular shaped container with a bottom surface 83 which includes a number of ¼" diameter apertures 84 for allowing the plating solution in the anode to flow to the workpiece 12. In addition to the plating surface, the anode container includes four wall surfaces 85 which form the container. A top 86 is bolted to the anode along a flange 87 extending around the perimeter of the anode container. The anode is maintained above the workpiece by a frame 88 to which the anode is bolted. The top is of a nonconducting material such as Lucite (registered trademark) and helps maintain a contact bar 90 in place. The contact bar 90 serves as a convenient method of attaching the anode to a DC source of electrical potential for maintaining current flow for the plating reaction.

In the embodiment illustrated, the conduit 63 is seen to enter the anode container from the top. Once inside the anode, the conduit can branch into a "T" or other appropriate fittings 92 which routes the plating solution to either side of the anode container.

The pressure supplied by the pump 62 can be adjusted to alter the fluid flow through the anode. Higher pressure results in faster fluid flow through the apertures and insures that the gap between the workpiece and the anode remains filled during the plating operation. The flow necessary to maintain a full volume of electrolyte in the gap is dependent on the cross-sectional area of the overflow from the gap to the sump. This area is the anode length times the anode to workpiece distance. Overflow on the exit and entrance ends can be minimized by a baffle 94 positioned at either end of the anode. (see FIG. 3). The baffle extends across the width of the anode and directly contacts the workpiece to force the solution from the sides of the workpiece into the sump. Should solution seep past the baffle, a pair of squeegee rolls 43, 96 (see FIG. 2) prevent solution flow past the sump.

Tests indicate that the flow rate required to maintain a completely filled gap is roughly proportional to the overflow area. Thus, if the gap width is halved while the anode length maintained a constant, the solution flow rate needed to fill the gap can also be halved.

FIG. 3 illustrates the guide rollers 82 which position the workpiece in relation to the anode unit. By loosening a pair of connectors 98 on either side of the rollers 82, the vertical positioning of the guide rollers can be adjusted. This adjustment fixes the gap between the workpiece and the anode. Through modification of the anode/workpiece distance, the user can empirically insure the gap is completely filled with solution and thereby achieve maximum plating current flow.

Positined beneath each plating anode unit 16*a* are two masking plates 100 which are moved in and out of the plating solution flow. These masking plates are adjusted to restrict current flow to the workpiece edges and thereby prevent two undesirable phenomena known as edge buildup and tree growth. In the preferred embodiment of the invention, these masks comprise either stainless steel plates 1.9 mm thick coated with 1.0 mm of paint to insure electrical insulation, or a suitable nonconductive material, such as plastic.

Tree growth and edge buildup can occur when the plating solution is allowed to flow unrestricted from the anode to the workpiece. Tree growth is illustrated schematically at 102 in FIG. 4. The filamentary so-called "trees" grow along the edge of the workpiece and degrade the plating near the workpiece edge. Edge buildup is a phenomenon where macroscopic nodules appear along the workpiece edges and result in a nonuniform plating.

Tests have shown that by continuously masking off a portion of the current flow, it is possible to eliminate these phenomena. During plating, the masking plates are positioned so that, depending on operational current density, their edges nearly coincide with or overlap the edge of the workpiece (see FIG. 5). With the masks in this position, it has been observed that neither the trees nor the nodules appear along the edge of the workpiece. Excess plating deposition on or close to the strip edge is prevented because current path is not continuous beyond the strip edge.

One technique for mounting the plating masks is shown in FIG. 3. A mask plate guide 104 is attached to the frame 88 and is therefore fixed in relation to the anode unit. The masks 100, slide along a region 106 of the guide parallel to the anode plating surface. The vertical positioning of the guide 104 is such that by sliding the mask 100 along this region 106, the mask reduces the area of current flow within the gap between the anode and strip. Positioning of the masks varies depending upon the width of the material to be plated. Should adjustments be deemed necessary due to tree or nodule growth, the masking plates are moved to the desired position manually or automatically along the guide 104. In this way, the plating user maintains control over the masking width and can vary that positioning depending upon the results obtained during the plating process.

It should be appreciated that certain design modifications could be incorporated without departing from the scope of the invention. In particular, it should be noted that the anode units can be positioned in a vertical configuration and the plating solution pumped onto a vertically positioned workpiece. The solution contacts the workpiece and the anode momentarily and then flows off the workpiece due to gravitational forces. It is also possible, as described in more detail below, that the anode may be positioned below the workpiece and solution may be forced into a gap between workpiece and anode and allowed to flow off the sides of the anode.

In operation, the drive rollers move the strip workpiece past the anode units as the plating solution is pumped from the source 15 to the units 20 and onto the workpiece. The number of anode units necessary to achieve proper plating thickness depends upon workpiece speed, the plating current density and the thickness required. The potential difference between anode and workpiece causes the plating reaction and current uniformity is maintained by insuring the gap remains filled. For different gap widths, solution flow is monitored and adjusted to assure current continuity.

Figure 6:
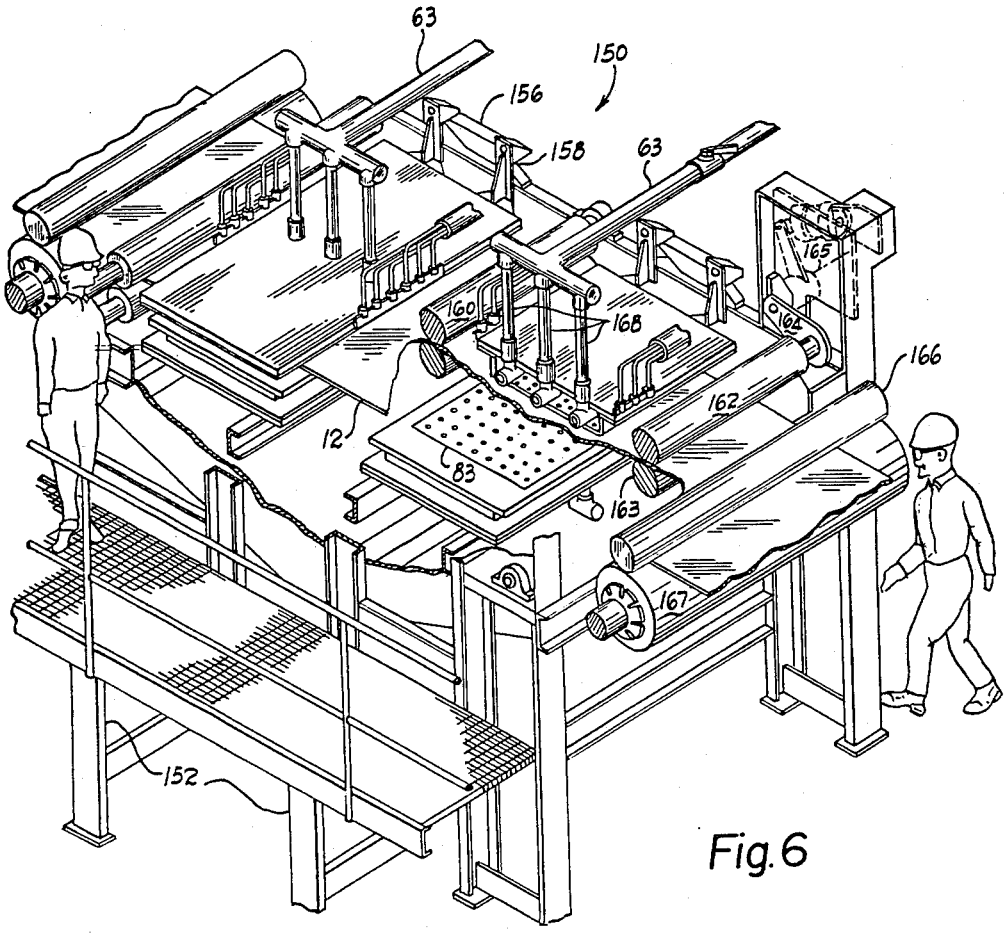
FIG. 6 is a fragmentary view, partially broken away, of a portion of the system of FIG. 1.

Referring now to FIG. 6, a two anode plating station 150 is illustrated. This station comprises a framework 152 for mounting two anode units and a number of rollers. The rollers maintain relative position of the strip and anodes, and in addition maintain electrical potential differences between the two.

As was the case for the anode shown in FIG. 3, each unit depicted in FIG. 6 comprises an insoluble anode as illustrated in and described in connection with FIG. 3. The anode container has a number of holes in its bottom for allowing plating solution to flow from the inlet conduit 63 to the strip 12 of steel as it passes through the station. The anode containers in FIG. 6 rest upon a framework 156 which is connected to an adjustable portion 158 of the framework 152. The support 156 defines a box-like structure with an appropriate inside dimension for receiving the anode flange 87. Since the framework 152 and support 156 are fixed in relation to their surroundings, the anode is similarly fixed.

Attached to the framework 152 are a pair of positioning rollers 160 and squeegee rollers 162, 163. The positioning rollers 160 serve to position the strip of steel at a fixed distance from the anode surface as it passes by the plating solution. The squeegee rollers 162, 163 prevent plating solution from flowing along the strip past the sump edges where it might interfere with the electrical contacts to the strip. The top squeegee roll 162 is rotatably mounted to a bracket 164 attached to the framework 152. The bracket 164 is mounted to pivot about an axis 165 parallel to the strip's surface. This rotational freedom allows the squeegee to accommodate strips of varying thickness and also to accommodate irregularities in the strip.

Also shown are a hold down roll 166 and a contact roll 167. The contact roll is used to maintain the strip at a constant electrical potential as it passes past the station. As its name suggests, the hold down roll merely helps maintain the strip in its path of travel past the plating station.

The conduit 63 shown in FIG. 6 branches into three inlets 168 which insure solution flow completely fills the anode container. As was the case with the embodiment shown in FIG. 3, each unit terminates with a tee outlet for injecting fluid into the container holes it passes to the strip, and then flows off the strip edges into the sump for recirculation and replenishment as the plating process continues.

Figure 7:
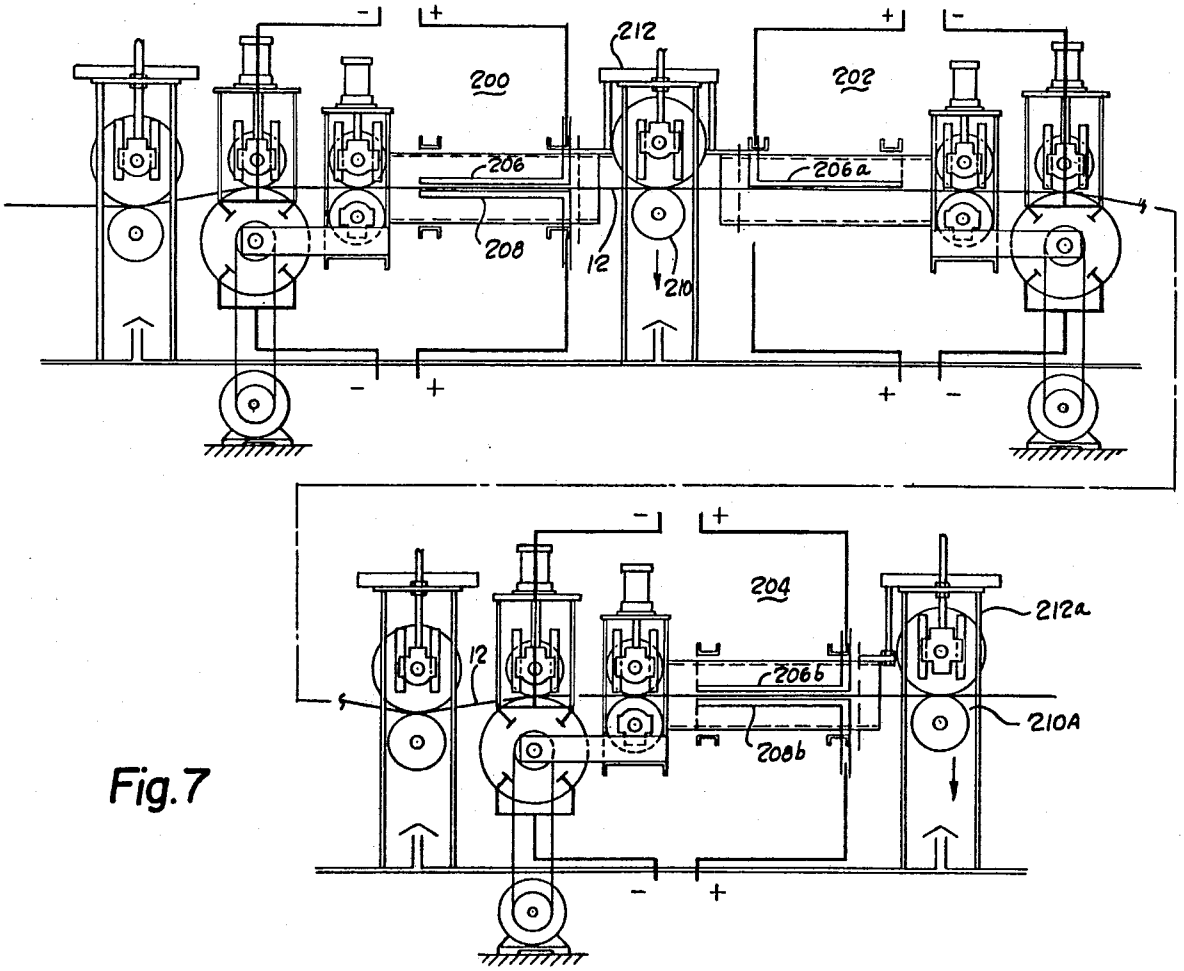
FIGS. 7 and 7A are elevational views of other embodiments of inventive aspects of the system illustrated in FIG. 1.

Principles utilized in connection with the one side plating apparatus described in connection with FIGS. 2–6 can also be employed in two sided plating. FIG. 7 shows an example of a two sided plating system incorporating these principles. Two sided plating, in addition to offering the obvious advantage of plating simultaneously both sides of the strip workpiece, also provides the flexibility of differential plating, i.e., application of plating of different thickness to opposite sides of the strip.

Referring to FIG. 7, there is shown a portion of a plating line incorporating three plating units 200, 202, 204. The first and last plating units 200, 204 each include a top anode 206, **206*b* and a bottom anode 208, 208*b* located respectively on the upper and lower sides of the strip path. The middle plating unit 202 includes only a top anode 206*a*** positioned above the strip path. The anodes of FIG. 7 are, for purposes of simplicity, shown schematically, but are to be understood as constructed in accordance with the more specific descriptions herein for anode structure.

In the embodiment of FIG. 7, each top anode is similar to the anode described in connection with the embodiment of FIGS. 2–6. Their principle of operation is also similar.

The bottom anodes, 208, **208*b***, as described in more detail below, include structure for injecting plating fluid into the gap between the top of the bottom anode and the underside of the strip to be plated. Fluid forced through the anode fills the gap therebetween, whereby plating is effected, after which the fluid falls back to the sump. Specifics of particular injection anode configuration are discussed in detail below.

Figure 7A:
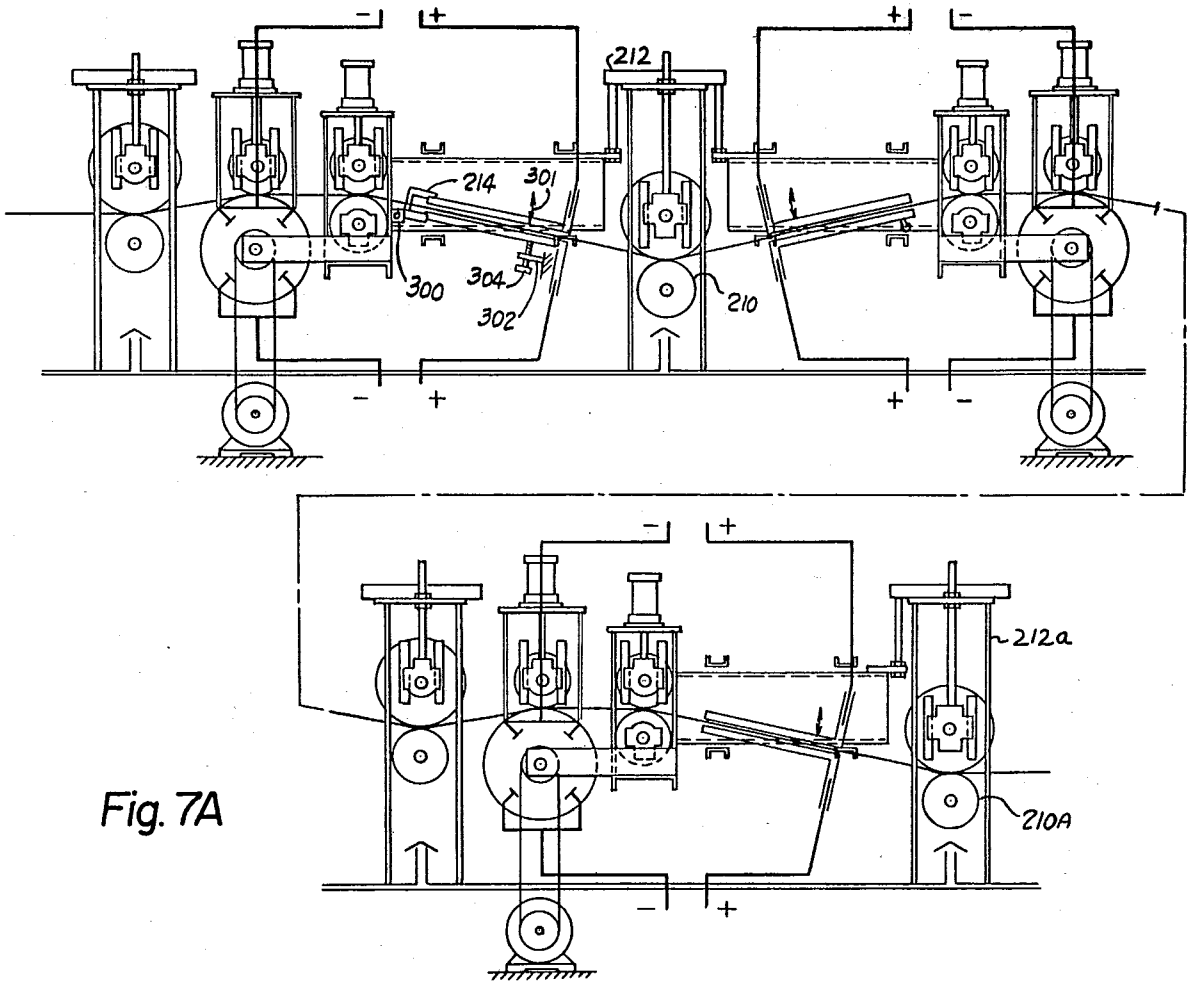

The plating system embodiment illustrated in FIG. 7A operates similarly to that of FIG. 7, but also provides the means to insure air and gas removal from the underside of the strip; to increase the metal ion supply, and to maintain strip flatness. These conditions increase plating rate and coating uniformity as discussed above.

More specifically, FIG. 7A shows means and structure for inclining to the horizontal both the plating anodes and the strip path, such that, in the plating unit regions, the strip is inclined approximately 5°. Tests have shown that even this small inclination can markedly improve plating uniformity and performance. FIG. 7A exaggerates this inclination for purposes of clarity.

In order to achieve this flexibility, the system of FIG. 7A incorporates structure for adjusting the height of deflecting rollers 210, 210A, along the path of the strip. Additionally, the system includes pivot structure for changing the attitude of the anodes simultaneous with the inclination of the strip path.

The deflection rollers are mounted on appropriate slotted stationary vertical members 212, 212*a*. Adjustable journal and support structure for the deflection rollers can be provided by one of ordinary skill to rotatably fasten each end of the deflection rollers at an adjustable height in a slot. When the deflection rollers are lowered, the path of the strip is deflected downwardly, such that the strip, during its passage through the adjacent plating units and between the anodes, is inclined as shown in FIG. 7A. Complementary pivot adjustment mechanism pivotably couples the anodes to the frame such that the anodes can be similarly inclined when the deflection rollers are lowered. The specific nature of this pivot structure is within the realm of ordinary skill to provide.

An example of the pivot structure is shown at 214. it is to be understood that each plating unit has a substantially identical pivot mechanism associated with its anodes, even though only one such mechanism is shown.

The pivot mechanism includes a rigid arm structure to which both the upper and lower anodes are fixed. The arm structure is journalled to the frame to afford rotatable motion of the anodes in the directions indicated by the arrows 301.

An adjustable stop is provided to determine the degree of downward inclination of the anodes to the horizontal. The stop mechanism includes a flange 302 anchored with respect to the frame. A threaded hole through the flange accommodates a threaded bolt 304. The bolt limits the anodes pivoting such that the anodes are stopped at an orientation determined by how far the bolt is screwed through the flange.

Figure 8:
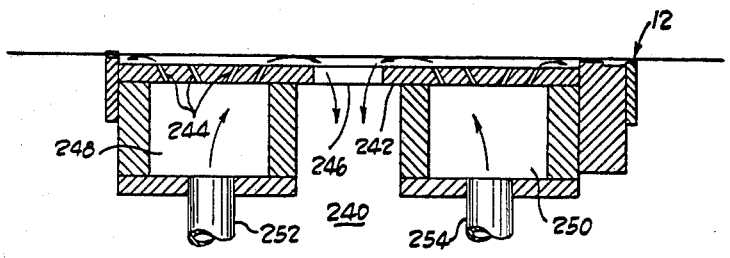
FIGS. 8–9 are cross-sectional views of portions of the system illustrated in FIG. 7.
Figure 9:
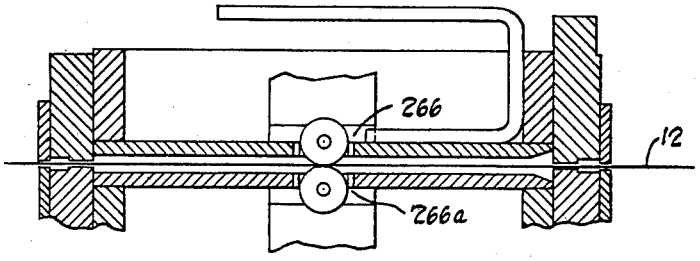
Figure 10:
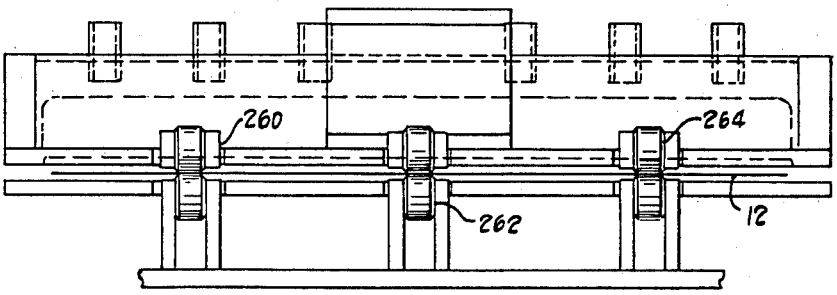
FIG. 10 is an elevational view showing in detail the portion of the system of FIG. 7 illustrated in FIG. 9.

FIGS. 8–10 illustrate alternative embodiments of the anodes and associated elements.

A lower anode 240 is shown in FIG. 8. This lower anode consists of a top portion 242 having a number of small divergent apertures 244 and a large central aperture 246. Additional structure defines plating fluid chambers 248, 250 beneath the area incorporating the smaller apertures. Plating fluid from the supply is forced upwardly through conduits 252, 254 to the plating chambers, from which it exits upwardly into the gap between the anode and the workpiece 12. Plating fluid exits downwardly from the gap by way of the large central opening 246, and also by falling from the outside edges of the gap.

As discussed above, the uniformity and effectiveness of plating can be adversely affected by bowing of the strip workpiece in the region of the plating anode. This results from undesirable nonuniformity in the gap width on both sides of the strip. FIGS. 9 and 10 illustrate one means of reducing this bowing in the area of the anodes by the use of appropriately positioned rollers to more adequately support the strip within the gap.

Particularly as shown in FIG. 10, three pairs of rollers 260, 262, 264 are disposed in a line perpendicular to the strip path across its width. Preferably, the rollers are spaced about 18 inches apart and are approximately 3 inches in diameter, and are rotatably carried by the anodes. As shown in FIG. 9, notches 266, 266*a* are provided in both the upper and lower anodes in order to accommodate the row of rollers.

Tests have shown that it is often advantageous, in two-sided plating, to provide a higher solution flow rate from the bottom anode than from the top. Such a technique assists in removing gas from the underside of the strip, and the upward momentum of the solution helps to support the strip. It has been found that a ratio of bottom to top flow rate of about 1.5:1 is suitable.

Figures 11, 12, 13, 14:
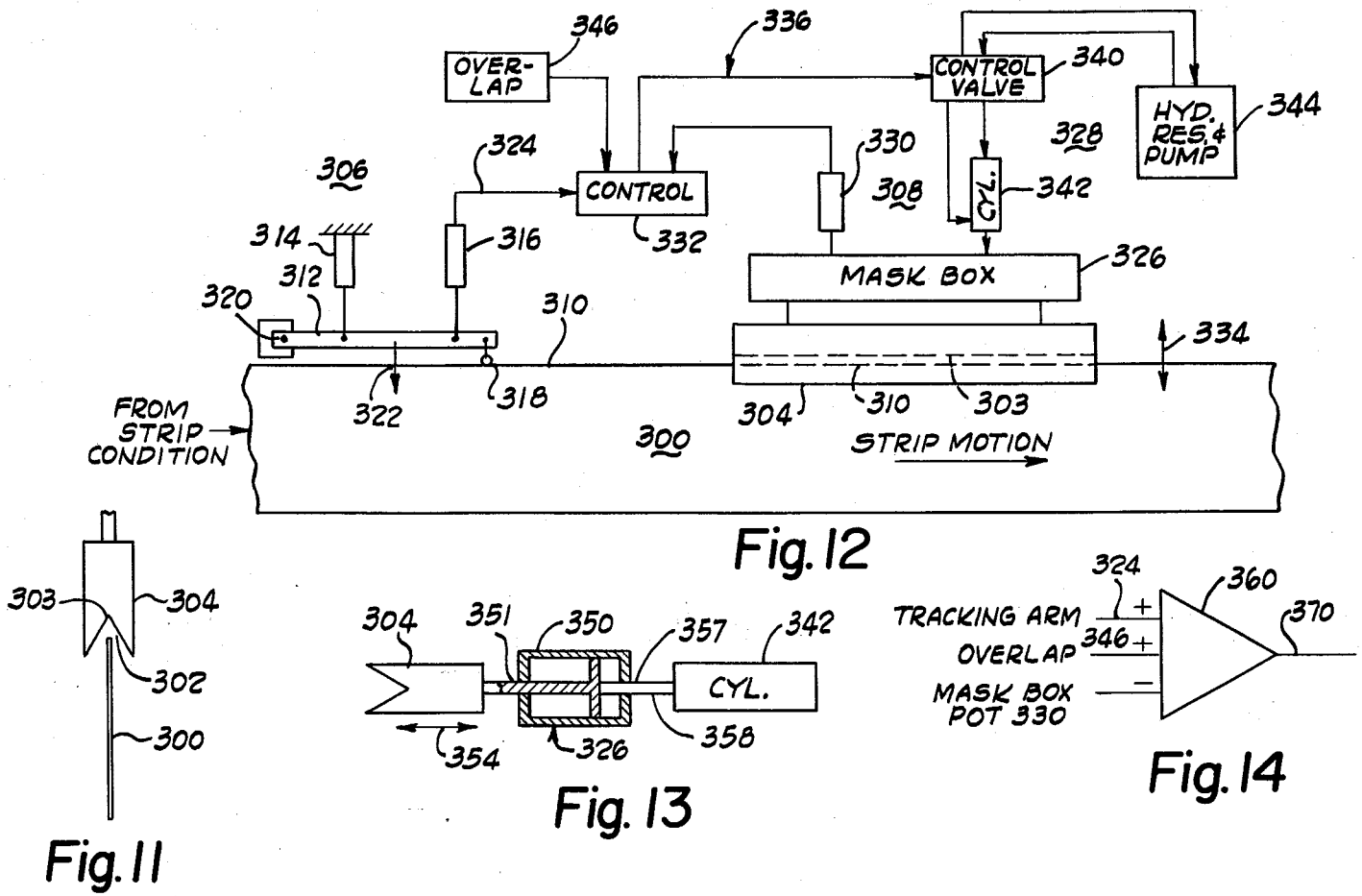
FIG. 11 is a fragmentary cross-sectional view of a strip end elevational view of an alternate embodiment of a mask of the system of FIG. 5.
FIG. 12 is a plan view, partly in block form, of an additional portion of the system of FIG. 6.
FIG. 13 is an end cross-sectional view of a portion of the system of FIG. 12.
FIG. 14 is a segmatic view of a portion of the system of claim 12.

FIG. 11 shows an alternate embodiment for the masking elements which tests have shown has superior performance in some cases relative to the masking structure already described. FIG. 11 shows a fragmentary cross-sectional view of a steel strip 300.

The edge of the strip 300 extends partially into a V-shaped groove or notch 302 defined by an insulative masking element 304. This single masking element can replace the separate dual masks above and below the strip which have been described in connection with two sided plating. It has been found that the mask 304 can have superior capabilities in shaping the current density near the strip edge. Preferably, the mask can be positioned such that the strip protrudes from $\frac{1}{4}$-inch upwards into the groove to effect optimum masking results.

For simplicity, only one masking element 304 is shown, but it is intended that a similar masking element be used on the opposite (left) edge of the strip as well.

It is also to be understood that the mask 304 can suitably comprise an assembly of insulative parts defining the groove or notch, as well as the integral unitary element shown in FIG. 11.

FIG. 12 is a plan view, partly in block form, of a servo control system for moving the mask element 304, as used in the plating system described here. The mask control system monitors the location, transverse to strip movement, of the strip edge, and maintains a predetermined adjustable overlap of the mask element with respect to the strip edge. The mask control system is desirable because, notwithstanding the provision of tracking adjustment systems described above, the moving strip still exhibits some sideways "wandering" with respect to its longitudinal primary movement.

For clarity, the anodes in the plating cell are not illustrated in FIG. 12, and only one of two mask control systems is illustrated. It is to be understood that, in practice, two mask control systems are preferably employed, one on either side of the strip edge in the plating cell region.

The mask control system includes an edge tracking section 306 and a mask actuation section 308. The mask tracking section senses the lateral location of the strip edge 310, and controls the mask adjustment section 308 to move the mask laterally in response to strip edge sideways movement in order to maintain the mask at a position such that the degree of protrusion of the strip edge into the groove or notch 302 of the mask 304 is maintained substantially constant. This feature maintains a current distribution near the strip edge which is substantially uniform.

The edge tracking station includes a tracking arm 312, an air cylinder 314 and a linear potentiometer 316.

A sensing roller 318 is mounted near one end of the tracking arm 312.

The tracking arm is pivotedly mounted at a location 320 for rotational movement about the pivot in substantially the plane of the strip. The air cylinder 314 is provided with plant air pressure to bias the tracking arm toward the strip edge, i.e. in the direction indicated by an arrow 322. When so biased toward the strip edge, the sensing roller 318, which is a rotationally mounted stainless steel roller, impinges against the edge of the strip. When the strip edge wavers sideways as the strip progresses along its longitudinal path of movement, the tracking roller causes the tracking arm 312 to move accordingly. The tracking arm movement adjusts the output of the linear potentiometer 316 (which is supplied with a direct current voltage in known fashion) such that the output at the lead 324 is a function of the tracking arm position and hence of the strip edge lateral location.

The mask adjustment section 308 includes a mask box assembly 326, an hydraulic system 328, a linear potentiometer 330 and an electronic control system 332.

The mask box 326, described in more detail below, includes mechanical linkage for supporting the mask 304 for lateral movement back and forth in the direction illustrated by an arrow 334. The hydraulic system 328, in response to a signal appearing on a lead 336, adjusts the location of the mask by way of exerting force on elements of the mask box assembly 326.

The linear potentiometer 330 is coupled to the mask by way of the mask box assembly, such that its output represents the location of the mask laterally with respect to strip longitudinal motion. The output of potentiometer 316, representing actual strip edge location, and of potentiometer 330, representing mask location, are both directed to the control electronics 332. The control electronics compares these two signals, and produces an output on a lead 336 which is a function of the difference between them. The output from the lead 336 is applied to a servo control valve 340, which represents a portion of the hydraulic system 328. The servo control valve position is adjusted as a function of the output on the lead 336. As the control valve is adjusted, it regulates the amount and direction of hydraulic force applied by double acting hydraulic cylinder 342 on an element of the mask box assembly coupled to the mask itself. Thus, the lateral location of the mask is adjusted as a function of the comparison between mask location and edge location, as sensed by the potentiometers 316, 330. The hydraulic system 328 is supplied with energy by way of a known hydraulic reservoir and pumps designated by reference character 344.

An overlap adjustment circuit 346 is also provided. By adjusting the overlap circuit, such as by way of an adjustable knob, in a way described in more detail below, the comparator of control circuitry 332 is governed to correspondingly adjust the overlap of the mask over the strip edge. That is, the adjustment of the overlap circuit 346 controls the relationship of the location of the mask 304 with respect to that of the edge sensing roller 318.

The hydraulic system 328, being of a known type and readily providable by one of ordinary skill, is not described in detail here.

FIG. 13 illustrates in cross-section the end view of the mask box assembly 326. The mask box assembly comprises a housing 350 defining a longitudinal slot 351 for movably accommodating therein a mask slide element 352. The slide element is free to move back and forth in the directions indicated by an arrow 354. The mask element 304 is affixed to the left-hand end of the side element 352.

The housing 350 describes another opening 357 on the side opposite the opening 351, for accommodating a piston rod 358 extending from the hydraulic cylinder 342. When the hydraulic cylinder is actuated by control of the servo valve 340 to move the mask, force is applied by way of the rod 358 to the actuator element 352 in order to accomplish this.

FIG. 14 illustrates the circuitry of the control circuit 332 and the overlap circuit 346. This circuitry comprises an operational amplifier 360 coupled as a comparator. The output 324 from the tracking arm potentiometer 316 is applied to a plus-input of the operational amplifier. The output of the mask box potentiometer 330 is applied to a minus terminal of the operational amplifier, this potentiometer output signal indicating mask location is a lateral direction. Without more, the operational amplifier would produce at its output 336 a signal representing the different between the edge tracking signal and the mask location signal.

The overlap adjustment signal from the overlap circuitry 346 is applied to another plus input to the operational amplifier. As can clearly be seen, the magnitude of the overlap signal governs the relation between the output at 336 and the difference between the edge tracking and mask location signals, such that by adjusting the overlap signal, one can control the location of the mask 304 with respect to the strip edge location as sensed by the roller 318.

It is to be understood that the disclosure here provided is illustrative, rather than exhaustive, of the invention. Those of ordinary skill in the relevant technical field will be able to provide additions, deletions and modifications to the specific structure set forth here without departing from the spirit or scope of the invention, as delineated in the appended claims.

I claim:

1. A system for electroplating a metallic workpiece with a plated coating, said system comprising:

(a) a plating electrode;

(b) drive structure for delivering the workpiece to a region proximate the electrode;

(c) circuitry couplable to a source of electric power for causing electric current flow between the workpiece and the electrode;

(d) apparatus for delivering plating fluid containing ions of the intended plating coating to a region between the electrode and the workpiece, and (e) conditioning apparatus for applying plating coating ions to the workpiece surface prior to its delivery to the region of the electrode.

2. The system of claim 1, wherein:

(a) the plating coating material comprises zinc, and (b) said conditioning apparatus comprises means for delivering a zinc sulphate solution to the workpiece surface.

3. A system for electroplating a coating onto a metallic strip workpiece, said system comprising:

(a) drive structure for propelling the workpiece longitudinally along a path;

(b) a plating electrode proximate the path;

(c) circuitry couplable to an electric power source for causing current to flow between the electrode and the workpiece;

(d) apparatus for delivering plating solution to a region between the electrode and the workpiece;
(e) masking structure mounted for interposition between the electrode and the strip in the region of a strip edge;
(f) a sensor for detecting lateral deviation of strip movement with respect to said path, and
(g) adjustment apparatus responsive to the sensor for moving said mask laterally with respect to said path for tracking said strip workpiece lateral deviation.

4. The system of claim 3, further comprising:
(a) another masking element mounted for lateral movement proximate the other strip edge, and
(b) second adjustment apparatus coupled between said another masking element and said sensor for causing said another masking element to track lateral deviation of the strip from said path.

5. The system of claim 3, wherein said sensor comprises:
(a) a mechanical contact element mounted for impingement against an edge of said strip, and
(b) a linear potentiometer and associated circuitry for producing a voltage which is a function of the lateral position of said strip along said path.

6. A system for electroplating two sides of a stirp workpiece, said system comprising:
(a) drive structure for longitudinally propelling the strip along a path;
(b) an upper electrode above said path;
(c) a lower electrode below said path;
(d) circuitry couplable to an electric power source for establishing and maintaining electrical potential difference between the upper electrode and the strip and the lower electrode and strip;
(e) apparatus including the upper electrode for delivering plating fluid at a first flow rate to downwardly impinge on the strip in the region between the upper electrode and the strip; and,
(f) apparatus including the lower electrode for delivering plating fluid at a second flow rate different from said first flow rate to impinge upwardly against the bottom surface of the strip to exert an upward force on the strip.

7. The system of claim 6, wherein:
said first solution delivering apparatus delivers fluid to impinge on the upper strip surface at a flow rate equal to about two-thirds of the flow rate at which the lower solution delivering apparatus causes fluid to impinge upwardly against the lower strip surface.

8. A system for electroplating a metallic strip workpiece, said system comprising:
(a) driver structure for propelling the strip longitudinally along a path;
(b) a plating electrode near the path;
(c) means for delivering plating fluid to a region between the electrode and the strip;
(d) circuitry couplable to a source of electric power for causing current flow between electrode and strip, and
(e) insulative masking structure defining a non-rectangular grooved cross-section and being located proximate a portion of a strip edge for facilitating partial protrusion of an edge portion of the strip into the grooved region about the upper and lower surface of an edge of said strip.

9. A method for simultaneously plating the two sides of a steel strip comprising the steps of:
(a) preparing a liquid plating solution with metallic ion concentrations for plating on the steel strip;
(b) substantially superimposing two separate non-submersed plating anodes in closely spaced relation to opposed sides of the steel strip to define a fluid flow path between each anode and its respective facing side of the strip;
(c) flowing the liquid plating solution along the paths in sufficient volume to establish electrical flow paths from each anode to its respective facing strip side with each electrical flow path being established substantially across the strip width;
(d) restricting solution buildup between the anodes and the strip by allowing gravity flow of said solution off the sides of said strip to a sump, and
(e) establishing independently adjustable electrical potential difference between each of the separate anodes and the strip to cause ions in the plating solution to form a coating on both sides of the steel strip.

10. The method of claim 9 wherein the step of establishing electrical potential on the anodes comprises individually adjusting the potentials of each electrode to different non-zero levels.

11. The method of either claim 9 or 10 further comprising the step of adjusting the separation between the strip and the anodes.

12. Plating apparatus for simultaneously electroplating both surfaces of a conductive strip comprising:
(a) structure establishing a non-submersed workpiece path of travel;
(b) a separate non-submersed insoluble anode mounted near the path superimposed on each side of the strip;
(c) solution supply means for supplying a plating solution.

13. The plating apparatus of claim 12 wherein a strip cross section is parallel to the horizontal and the path of travel in the vicinity of the anodes is both non-submersed and inclined with respect to the horizontal.

14. The plating apparatus of claim 12 which further comprises means for inhibiting current flow through a portion of the space to control plating uniformity across the strip width.

15. A plating system comprising:
(a) apparatus for disposing a workpiece having a generally flat surface near a plating station with the flat surface being non-submersed and facing generally downwardly, but inclined to the horizontal;
(b) a non-submersed electrode also defining a flat surface located below the flat workpiece surface said flat electrode surface being generally parallel to the workpiece surface;
(c) apparatus for interposing an ion-containing plating solution between the electrode and said flat surface, and
(d) circuitry for maintaining an electrical potential difference between the workpiece surface and the electrode.

16. A plating system comprising:
(a) structure defining a plating station;
(b) apparatus for presenting a workpiece at a non-submersed location near the station;
(c) two separate electrodes near the station;

(d) circuitry for maintaining electrical potential difference between the electrodes and the workpiece at the station;

(e) apparatus for interposing an ion-containing plating solution between the electrodes and workpiece, and (f) electrically insulating material interposed between the electrodes to inhibit plating of an electrode caused by undesirable variations in the respective electrical potentials of the electrodes.

17. A method for plating a metallic strip product comprising the steps of:

(a) passing the strip over a nonsubmersed travel path under a tension deliberately selected as sufficiently low to cause a portion of the strip substantially to exaggerate bowing downwardly by gravity;

(b) contacting the underside of the strip with plating solution;

(c) producing an electric current through the strip and solution for plating the strip.

18. A system for plating two-sided material, the system comprising:

(a) a pair of substantially mutually electrically isolated electrodes;

(b) apparatus for passing the material a non-submersed path between the electrode pair with one side facing each electrode;

(c) apparatus for flowing plating solution between each electrode and its respective facing side of the material substantially without providing an inter-electrode current path through the solution, and (d) circuitry for producing electric current flow between each electrode and material, by way of the solution.

19. Apparatus for simultaneously plating the two sides of a steel strip by use of a plating solution having metallic ion concentration for plating on the steel, said apparatus comprising:

(a) two separate substantially superimposed plating anodes each located in a closely spaced facing relationship with respective opposite sides of the steel strip to define a fluid flow path between each anode and its respective facing side of the strip;

(b) apparatus for flowing the liquid plating solution along the fluid flow paths in sufficient volume to establish electrical flow paths from each anode to its respective facing strip side, with each electrical flow path being established substantially across the strip width;

(c) said plating apparatus including said anodes being configured for facilitating gravity flow of said solution off the sides of the strip for inhibiting solution buildup between the anodes and the strip, and (d) circuitry for establishing independently adjustable electrical potential difference between each of the separate anodes and the strip to cause ions in the plating solution to form a coating on both sides of the steel strip.

20. A system for electroplating a generally flat workpiece having top and bottom surfaces, said system comprising:

(a) a sump for containing a quantity of plating solution;

(b) means for supporting the workpiece in a generally horizontal orientation over the sump and spaced above the surface of plating solution in the sump, said workpiece being thus non-submersed;

(c) a top electrode supported above the workpiece and having a generally flat surface proximate and facing the workpiece top surface;

(d) a bottom electrode having a generally flat upper surface proximate and facing the workpiece lower surface, and located below the top electrode over the said sump, said bottom electrode being supported between the workpiece lower surface and the surface of solution in the sump;

(e) apparatus for filling the respective gaps between the workpiece and each of said electrodes simultaneously with plating solution for effecting simultaneous plating of both sides of the workpiece, and (f) circuitry for adjusting electrical potential between the workpiece and each of said electrodes.

21. The system of claim 20, further comprising:

said top and bottom electrodes being at least partially superimposed.

22. The system of claim 20, further comprising:

insulative masking structure interposed between the bottom surface of the top electrode and the top surface of the bottom electrode for inhibiting current flow directly between said electrodes.

23. A system for simultaneously electroplating both sides of a generally thin flat workpiece having top and bottom surfaces, said system comprising:

(a) apparatus for propelling the workpiece along a non-submersed path;

(b) a top anode located above and proximate the workpiece path;

(c) a bottom anode located below and proximate the workpiece path with the top anode being at least partially superposed over the bottom anode;

(d) first apparatus for delivering a first flow of plating fluid between the top anode and the workpiece;

(e) second apparatus for delivering a second flow of plating solution between the bottom anode and the workpiece;

(f) fluid control apparatus associated with said first and second fluid flow apparatus for separately adjusting the respective rates of said first and second plating fluid flow, and (g) circuitry for providing electrical potential difference between the anodes and the workpiece.

24. The system of claim 23, further comprising:

circuitry for independently adjusting the electrical potential between each of the top and bottom anodes and the workpiece.

* * * * *

UNITED STATES PATENT AND TRADEMARK OFFICE

CERTIFICATE OF CORRECTION

PATENT NO. : 4,401,523

DATED : August 30, 1983

INVENTOR(S) : Richard C. Avellone

It is certified that error appears in the above-identified patent and that said Letters Patent is hereby corrected as shown below:

Column 5, line 54, delete "17";
Column 6, line 62, change "55" to --16a--;
Column 6, line 67, change "57" to --17--;
Column 7, line 1, change "14" to --16a--;
Column 7, line 24, correct "electropolating" to --electro-plating--;
Column 9, line 41, delete "source 15 to the units 20" and substitute therefor --reservoir 17 to the plating section 14--;
Column 10, line 52, "anode" should be --anodes--;
Column 11, line 29, "it" should be --It--;
Column 14, line 22, "different" should be --difference--;
Column 15, line 26, "stirp" should be --strip--;
Column 16, line 54, after "surface", second occurrence, insert --when so disposed--;
Column 18, line 42, "superposed" should be --superimposed--;

Signed and Sealed this

Twentieth Day of December 1983

[SEAL]

Attest:

GERALD J. MOSSINGHOFF

Attesting Officer

Commissioner of Patents and Trademarks